US006014162A

United States Patent [19]

Kerr et al.

[11] Patent Number: 6,014,162

[45] Date of Patent: Jan. 11, 2000

[54] VACUUM IMAGING DRUM WITH MEDIA CONTOURS

[75] Inventors: Roger S. Kerr, Brockport; Dean L. Smith, Pittsford; Douglas A. Hons, Rochester, all of N.Y.

[73] Assignee: Eastman Kodak Company, Rochester, N.Y.

[21] Appl. No.: 08/914,078

[22] Filed: Aug. 18, 1997

[51] Int. Cl.[7] ..... B41J 2/435; G03C 8/18

[52] U.S. Cl. ..... 347/262; 346/134; 346/138; 346/139 D; 347/218

[58] Field of Search ..... 346/134, 138, 346/139 D; 347/215, 218, 217, 241, 262, 233, 153, 264; 503/227

[56] References Cited

U.S. PATENT DOCUMENTS 5,053,791 10/1991 Baek et al. ..... 346/138

5,268,708 12/1993 Harshbarger et al. ..... 346/134

*Primary Examiner*—John Barlow
*Assistant Examiner*—L. Anderson
*Attorney, Agent, or Firm*—Nelson Adrian Blish

[57] ABSTRACT

The present invention is for an image processing apparatus (10) for sheet thermal print media. The image processing apparatus (10) comprises a vacuum imaging drum (300) for holding thermal print media (32) and dye donor sheet material (36) in registration on the vacuum imaging drum (300). A printhead (500) moves along a line parallel to the longitudinal axis (X) of the vacuum imaging drum (300) as the vacuum imaging drum (300) rotates. The printhead (500) receives information signals and produces radiation which is directed to the dye donor sheet material (36) which causes color to transfer from the dye donor sheet material (36) to the thermal print media (32). The vacuum imaging drum (300), having media contours (328) on the outer surface to facilitate holding media onto a vacuum imaging drum (300) revolving at high speeds.

61 Claims, 14 Drawing Sheets

VACUUM IMAGING DRUM WITH MEDIA CONTOURS

FIELD OF THE INVENTION

This invention relates to an image processing apparatus in general, and more specifically to a vacuum imaging drum for such an apparatus capable of holding multiple sheets while revolving at high speeds.

BACKGROUND OF THE INVENTION

Pre-Press color proofing is a procedure that is used by the printing industry for creating representative images of printed material without the high cost and time that is required to actually produce printing plates and set up a high-speed, high volume printing press. These representative images may require correction and may be reproduced several times to satisfy customer requirements.

One such commercially available image processing apparatus, shown in commonly assigned U.S. Pat. No. 5,268,708, has half-tone color proofing capabilities. This image processing apparatus is arranged to form an intended image on a sheet of thermal print media in which dye from a sheet of dye donor material is transferred to thermal print media by applying thermal energy to the dye donor material. This image processing apparatus is comprised generally of a material supply assembly or carousel, lathe bed scanning subsystem (which includes a lathe bed scanning frame, translation drive, translation stage member, printhead, and vacuum imaging drum), and thermal print media and dye donor material exit transports.

The operation of the image processing apparatus comprises metering a length of the thermal print media, in roll form, from the material assembly or carousel. The thermal print media is measured and cut into sheets of a required length, transported to the vacuum imaging drum, registered, and wrapped around and secured onto the vacuum imaging drum. Next a length of dye donor material, in roll form, is metered out of the material supply assembly, measured, and cut into sheets of a required length. The dye donor material is transported to and wrapped around the vacuum imaging drum, such that it is superposed in registration with the thermal print media.

The thermal print media and the dye donor material are retained on the spinning vacuum imaging drum while it is rotated past the scanning subsystem to expose the thermal print media. The translation drive traverses the printhead and translation stage member axially along the vacuum imaging drum, in coordinated motion with the rotating vacuum imaging drum. These movements combine to produce the image on the thermal print media.

After the image has been written on the thermal print media, the dye donor material is removed from the vacuum imaging drum. This is done without disturbing the thermal print media beneath it. The dye donor material is then transported out of the image processing apparatus by the dye donor material exit transport. Additional sheets of dye donor material, each a different color, are sequentially superimposed with the thermal print media on the vacuum imaging drum and imaged onto the thermal print media as previously described, until the intended image is completed. The completed image on the thermal print media is unloaded from the vacuum imaging drum and transported to an external holding tray on the image processing apparatus by the exit transport.

The vacuum imaging drum is cylindrical in shape and includes a hollowed-out interior portion, and a plurality of holes extending through a surface of the drum for applying a vacuum from the interior of the vacuum imaging drum, for supporting and maintaining the position of the thermal print media and dye donor sheet material as the vacuum imaging drum rotates. The ends of the vacuum imaging drum are enclosed by cylindrical plates. The cylindrical end plates are each provided with a centrally disposed spindle which extends outwardly through support bearings and are supported by the lathe bed scanning frame. The drive end spindle extends through the support bearing and is stepped down to receive a DC drive motor armature which is held on by means of a nut. A DC motor stator is held stationary by the lathe bed scanning frame, encircling the armature to form a reversible, variable speed DC drive motor for the vacuum imaging drum. At the end of the spindle an encoder is mounted to provide timing signals to the image processing apparatus. The opposite spindle is provided with a central vacuum opening, which is in alignment with a vacuum fitting with an external flange that is rigidly mounted to the lathe bed scanning frame. The vacuum fitting has an extension which extends within but is closely spaced from the vacuum spindle, thus forming a small clearance. With this configuration, a slight vacuum leak is provided between the outer diameter of the vacuum fitting and the inner diameter of the opening of the vacuum spindle. This assures that no contact exists between the vacuum fitting and the vacuum imaging drum which might impart uneven movement or jitters to the vacuum imaging drum during its rotation.

The opposite end of the vacuum fitting is connected to a high-volume vacuum blower which is capable of producing 50–60 inches of water at an air flow volume of 60–70 cfm. The vacuum required varies during loading, scanning, and unloading of the thermal print media and the dye donor materials. With no media loaded on the vacuum imaging drum the internal vacuum level of the vacuum imaging drum is approximately 10–15 inches of water. With just the thermal print media loaded on the vacuum imaging drum the internal vacuum level of the vacuum imaging drum is approximately 20–25 inches of water. This level is required such that when a dye donor sheet material is removed, the thermal print media does not move, otherwise color to color registration will not be maintained. With both the thermal print media and dye donor sheet material completely loaded on the vacuum imaging drum the internal vacuum level of the vacuum imaging drum is approximately 50–60 inches of water.

The outer surface of the vacuum imaging drum is provided with an axially extending flat, which extends approximately 8 degrees around the vacuum imaging drum circumference. The vacuum imaging drum is also provided with a circumferential recess which extends circumferentially from one side of the axially extending flat circumferentially around the vacuum imaging drum to the other side of the axially extending flat, and from approximately one inch from one edge of the vacuum imaging drum to approximately one inch from the other edge of the vacuum imaging drum. The thermal print media when mounted on the vacuum imaging drum is seated in the circumferential recess and therefor the circumferential recess has a depth substantially equal to the thermal print media thickness seated there within which is approximately 0.004 inches in thickness.

The purpose of the circumferential recess on the vacuum imaging drum surface is to eliminate any creases in the dye donor material, as it is drawn down over the thermal print media during the loading. This assures that no folds or creases will be generated in the dye donor materials which could extend into the image area and seriously adversely affect the image. The circumferential recess also substantially eliminates the entrapment of air along the edge of the thermal print media, where it is difficult for the vacuum holes in the vacuum imaging drum surface to assure the removal of the entrapped air. Any residual air between the thermal print media and the dye donor material, can also adversely affect the intended image.

The purpose of the vacuum imaging drum axially extending flat is two fold, it assures that the leading and trailing ends of the dye donor material are protected from the effects of air drag during high speed rotation of the vacuum imaging drum during the imaging process. Without the axially extending flat, the air drag will tend to lift the leading or trailing edges of the dye donor material. The vacuum imaging drum axially extending flat also ensures that the leading and trailing ends of the dye donor sheet material are recessed from the vacuum imaging drum periphery. This reduces the chance of the dye donor material contacting other parts of the image processing apparatus, such as the printhead, causing a jam, possible loss of the intended image, or catastrophic damage to the image processing apparatus.

The vacuum imaging drum axially extending flat also acts to impart a bending force to the ends of the dye donor materials when they are held onto the vacuum imaging drum surface by vacuum from within the interior of the vacuum imaging drum. Consequently when the vacuum is turned off to that portion of the vacuum imaging drum, the end of the dye donor material will tend to lift from the surface of the vacuum imaging drum.

Although the present image processing apparatus is satisfactory, it is not without drawbacks. Throughput, the number of intended images per hour, is limited by the vacuum imaging drum rotational speed. With some constraints imposed by the technology itself, the faster the vacuum imaging drum rotates without the centrifugal forces or increased air turbulence separating the thermal print media and the dye donor sheet material from the vacuum imaging drum, the faster the intended image can be exposed onto the thermal print media, thus increasing the throughput of the image processing apparatus. However, with the existing image processing apparatus, the physical characteristics of the thermal print media, the interface of the axially extending flat, circumferential recess, and the dye donor material, limit the rotational speeds that are possible. At high rotational speeds, in excess of 1000 RPM, the centrifugal forces and air turbulence lift or separate the dye donor materials from the vacuum imaging drum surface at the corners of the sheet of dye donor material.

One approach to solving the above problem is adding external clamping components to hold the thermal print media and the dye donor sheet material to the vacuum imaging drum. This, however, adds increased cost and introduces mechanical complexity to the vacuum imaging drum design. This solution may also cause the vacuum imaging drum to go out of round as much as 80 microns, which would not allow the image processing apparatus to meet quality specifications. (The image processing apparatus tolerance requirement for focus is approximately 10 microns.) Clamping the thermal print media and the dye donor material would also introduce a clearance problem since the working distance of the printhead to the surface of the thermal print media loaded on the vacuum imaging drum is approximately 0.030 inches.

Another way to prevent the increased air turbulence and centrifugal force from separating the dye donor sheet material from the rotating vacuum imaging drum would be to add more vacuum holes or enlarge the diameter of the vacuum holes. This, however, would require an increase in the vacuum level in the interior of the vacuum imaging drum. A higher vacuum will increase in the cost of the blower that produces the vacuum, require complex vacuum coupling, adding additional cost, and higher customer operating costs with increased electrical consumption. In addition, there is a limit to how high the vacuum level can be without distorting the media, hence decreasing the image quality of the intended image.

Another problem with present vacuum imaging drum designs is that the corners of the dye donor material may cause a flute or ridge-like ripple to be formed in the dye donor material as the leading and trailing edge is drawn down at the axially extending flat. This fluting, where it extends over the thermal print media, will adversely affect the quality of the image.

SUMMARY OF THE INVENTION

It is an object of the present invention to provide a dramatic increase in through put of an image processing apparatus by increasing the rotational speed of the vacuum imaging drum.

It is another object of the present invention to provide an imaging apparatus capable of supporting dye donor material and thermal print media at multiple positions on donor support rings, to allow use of different lengths of the thermal print media and dye donor materials on the same drum.

It is the object of the present invention to eliminate fluting at the corners of the dye donor material.

The present invention is directed to overcoming one or more of the problems set forth above. Briefly summarized, according to one aspect of the present invention, a vacuum imaging drum, mounted for rotation about an axis, holds a sheet of thermal print media in registration with a sheet of dye donor material. A circumferential recess on a surface of the drum is approximately equal in length, width, and height to the thermal print media, so that the thermal print media fits into the recess. A first donor support ring and a second donor support ring on the surface of the drum, form a first edge and a second edge of the recess. An axially extending flat on the surface of the drum is adjacent a leading edge and a trailing edge of the thermal print media. A first media contour is located in the first donor support ring and a second media contour is located in the second donor support ring, both at opposite ends of the axially extending flat. The first media contour and the second contour bend corners of the dye donor material, to prevent fluting. In one embodiment, media contours are concave which insures full support and contact of the corner area of the dye donor material with the surface of the vacuum imaging drum.

Other embodiments of the invention include a single sheet vacuum imaging drum, multiple donor support ring position for use of different lengths of thermal print media dye donor material, and a vacuum imaging drum with no axially extending flat.

It is an advantage of the present invention that it can also be used on a vacuum imaging drum without an axially extending flat.

It is an advantage of the present invention that it can be used on a single sheet vacuum imaging drum.

It is an advantage of the present invention that can be implemented with only minor changes to prior art vacuum imaging drums and with no changes to the rest of the image processing apparatus.

It is an advantage of the present invention that there is no significant change in the mass of the vacuum imaging drum or its mechanical characteristics, minimizing the problem of distorting the vacuum imaging drum at high rotational speeds.

It is an advantage of the present invention that a change in bower design is not required.

By adding the media contours to the donor support rings at the ends of the axially extending flat, the dye donor material will be in full contact with the surface of the vacuum imaging drum and the rotational speed of the vacuum imaging drum can be increased to as high as 3000 rpm substantially increasing the through put of the image processing apparatus.

DETAILED DESCRIPTION OF THE INVENTION

Figure 1:
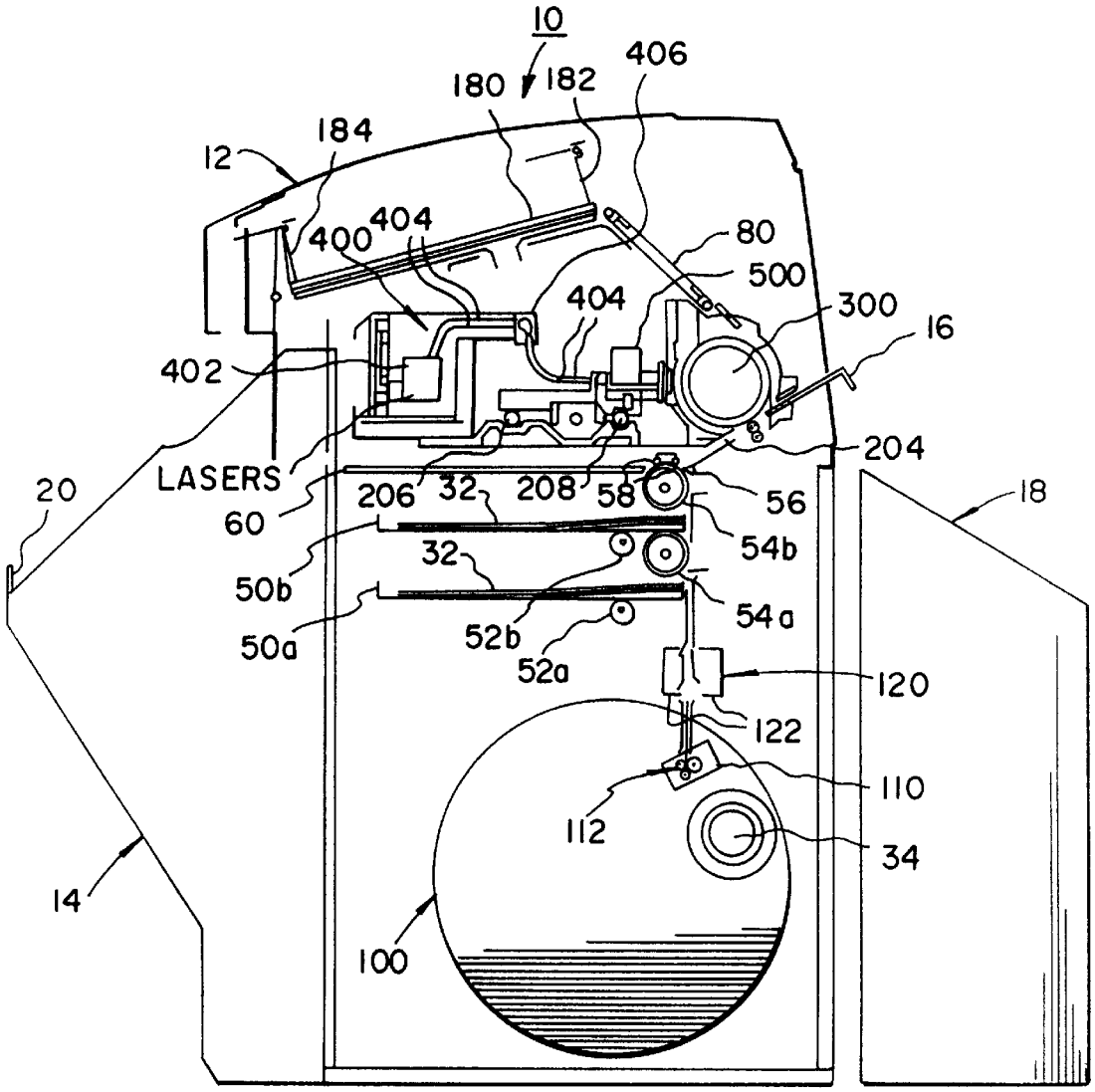
FIG. 1 is a side view in vertical cross-section of an image processing apparatus of the present invention.

Referring to FIG. 1, there is illustrated an image processing apparatus 10 according to the present invention having an image processor housing 12 which provides a protective cover. A movable, hinged image processor door 14 is attached to the front portion of the image processor housing 12 permitting access to the two sheet material trays, lower sheet material tray 50*a* and upper sheet material tray 50*b*, that are positioned in the interior portion of the image processor housing 12 for supporting thermal print media 32, thereon. Only one of the sheet material trays 50 will dispense the thermal print media 32 out of its sheet material tray 50 to create an intended image thereon; the alternate sheet material tray either holds an alternative type of thermal print media 32 or functions as a back up sheet material tray. In this regard, the lower sheet material tray 50*a* includes a lower media lift cam 52*a* for lifting the lower sheet material tray 50*a* and ultimately the thermal print media 32, upwardly toward a rotatable, lower media roller 54*a* and toward a second rotatable, upper media roller 54*b* which, when both are rotated, permits the thermal print media 32 to be pulled upwardly towards a media guide 56. The upper sheet material tray 50*b* includes a upper media lift cam 52*b* for lifting the upper sheet material tray 50*b* and ultimately the thermal print media 32 towards the upper media roller 54*b* which directs it towards the media guide 56.

The movable media guide 56 directs the thermal print media 32 under a pair of media guide rollers 58 which engages the thermal print media 32 for assisting the upper media roller 54*b* in directing it onto the media staging tray 60. The media guide 56 is attached and hinged to the lathe bed scanning frame 202 at one end, and is uninhibited at its other end for permitting multiple positioning of the media guide 56. The media guide 56 then rotates its uninhibited end downwardly, as illustrated in the position shown, and the direction of rotation of the upper media roller 54*b* is reversed for moving the thermal print medium receiver sheet material 32 resting on the media staging tray 60 under the pair of media guide rollers 58, upwardly through an entrance passageway 204 and around a rotatable vacuum imaging drum 300.

A roll of dye donor material 34 is connected to the media carousel 100 in a lower portion of the image processor housing 12. Four rolls are used, but only one is shown for clarity. Each roll includes a dye donor material 34 of a different color, typically black, yellow, magenta and cyan. These dye donor materials 34 are ultimately cut into dye donor sheet materials 36 and passed to the vacuum imaging drum 300 for forming the medium from which dyes imbedded therein are passed to the thermal print media 32 resting thereon, which process is described in detail herein below. In this regard, a media drive mechanism 110 is attached to each roll of dye donor material 34, and includes three media drive rollers 112 through which the dye donor material 34 of interest is metered upwardly into a media knife assembly 120. After the dye donor material 34 reaches a predetermined position, the media drive rollers 112 cease driving the dye donor material 34 and the two media knife blades 122 positioned at the bottom portion of the media knife assembly 120 cut the dye donor material 34 into dye donor sheet materials 36. The lower media roller 54*b* and the upper media roller 54*b* along with the media guide 56 then pass the dye donor sheet material 36 onto the media staging tray 60 and ultimately to the vacuum imaging drum 300 and in registration with the thermal print media 32 using the same process as described above for passing the thermal print media 32 onto the vacuum imaging drum 300. The dye donor sheet material 36 now rests atop the thermal print media 32 with a narrow gap between the two created by microbeads imbedded in the surface of the thermal print media 32.

A laser assembly 400 includes a quantity of laser diodes 402 in its interior, the lasers 402 are connected via fiber optic cables 404 to a distribution block 406 and ultimately to the printhead 500. The printhead 500 directs thermal energy received from the laser diodes 402 causing the dye donor sheet material 36 to pass the desired color across the gap to the thermal print media 32. The printhead 500 is attached to a lead screw 250 via the lead screw drive nut 254 and drive coupling 256 (not shown in FIG. 1) for permitting movement axially along the longitudinal axis of the vacuum imaging drum 300 for transferring the data to create the intended image onto the thermal print media 32.

For writing, the vacuum imaging drum 300 rotates at a constant velocity, and the printhead 500 begins at one end of the thermal print media 32 and traverse the entire length of the thermal print media 32 for completing the transfer process for the particular dye donor sheet material 36 resting on the thermal print media 32. After the printhead 500 has completed the transfer process, for the particular dye donor sheet material 36 resting on the thermal print media 32 the dye donor sheet material 36 is then removed from the vacuum imaging drum 300 and transferred out the image processor housing 12 via a skive or ejection chute 16. The dye donor sheet material 36 eventually comes to rest in a waste bin 18 for removal by the user. The above described process is then repeated for the other three rolls 30 of dye donor materials 34.

After the color from all four sheets of the dye donor sheet materials 36 have been transferred and the dye donor sheet materials 36 have been removed from the vacuum imaging drum 300, the thermal print media 32 is removed from the vacuum imaging drum 300 and transported via a transport mechanism 80 to a color binding assembly 180. The entrance door 182 of the color binding assembly 180 is opened for permitting the thermal print media 32 to enter the color binding assembly 180, and shuts once the thermal print media 32 comes to rest in the color binding assembly 180. The color binding assembly 180 processes the thermal print media 32 for further binding the transferred colors on the thermal print media 32 and for sealing the microbeads thereon. After the color binding process has been completed, the media exit door 184 is opened and the thermal print media 32 with the intended image thereon passes out of the color binding assembly 180 and the image processor housing 12 and comes to rest against a media stop 20.

Figure 2:
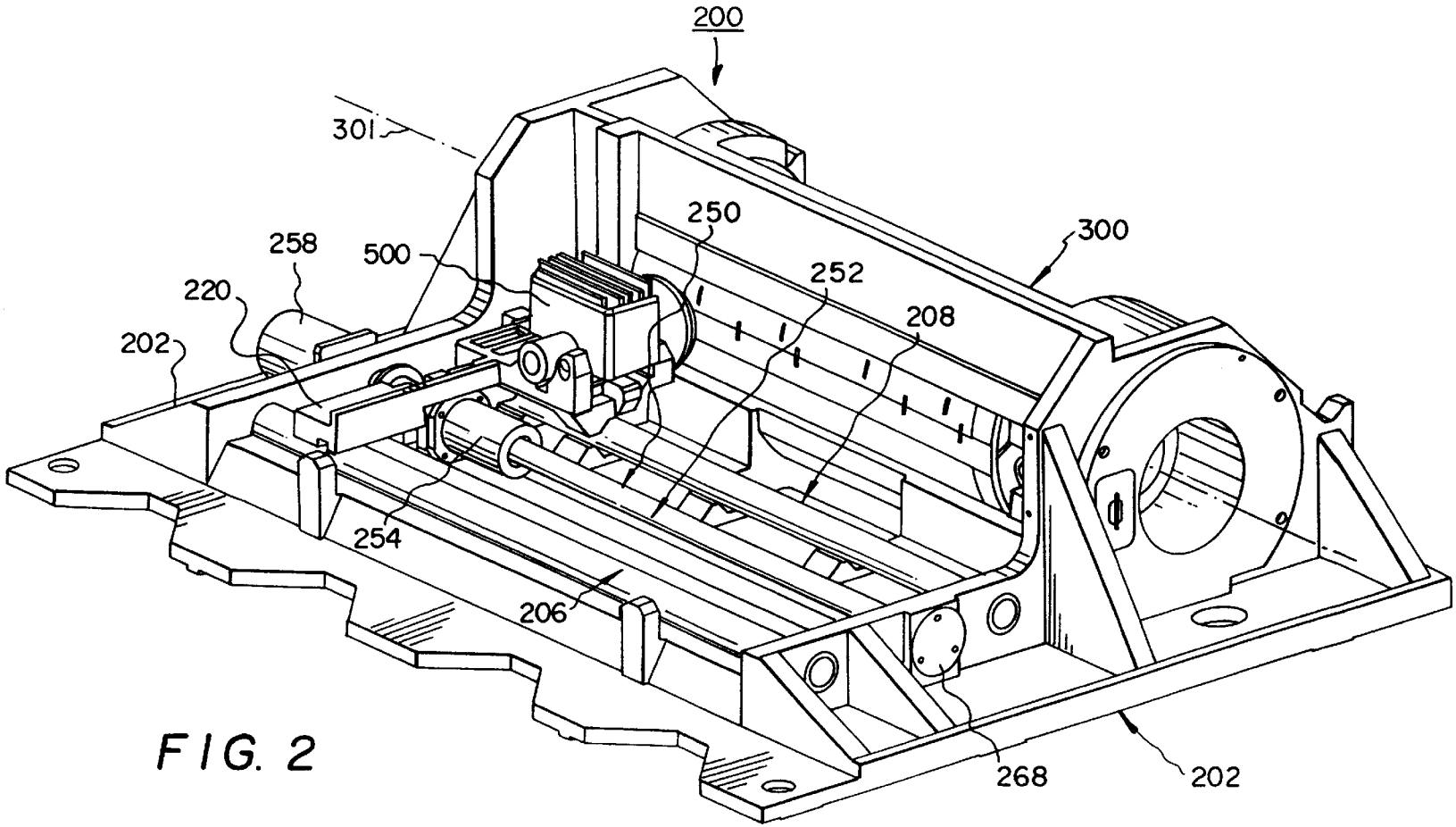
FIG. 2 is a perspective view of a lathe bed scanning subsystem of the present invention.

Referring to FIG. 2, there is illustrated a perspective view of the lathe bed scanning subsystem 200 of the image processing apparatus 10, including the vacuum imaging drum 300, printhead 500 and lead screw 250 assembled in the lathe bed scanning frame 202. The vacuum imaging drum 300 is mounted for rotation about an axis X in the lathe bed scanning frame 202. The printhead 500 is movable with respect to the vacuum imaging drum 300, and is arranged to direct a beam of light to the dye donor sheet material 36. The beam of light from the printhead 500 for each laser diode 402 (not shown in FIG. 2) is modulated individually by modulated electronic signals from the image processing apparatus 10, which are representative of the shape and color of the original image, so that the color on the dye donor sheet material 36 is heated to cause volatilization only in those areas in which its presence is required on the thermal print media 32 to reconstruct the shape and color of the original image.

The printhead 500 is mounted on a movable translation stage member 220 which, in turn, is supported for low friction slidable movement on translation bearing rods 206 and 208. The translation bearing rods 206 and 208 are sufficiently rigid so that they do not sag or distort between their mounting points and are arranged as parallel as possible with the axis X of the vacuum imaging drum 300 with the axis of the printhead 500 perpendicular to the axis X of the vacuum imaging drum 300 axis. The front translation bearing rod 208 locates the translation stage member 220 in the vertical and the horizontal directions with respect to axis X of the vacuum imaging drum 300. The rear translation bearing rod 206 locates the translation stage member 220 only with respect to rotation of the translation stage member 220 about the front translation bearing rod 208 so that there is no over-constraint condition of the translation stage member 220 which might cause it to bind, chatter, or otherwise impart undesirable vibration or jitters to the printhead 500 during the generation of an intended image.

Figure 3:
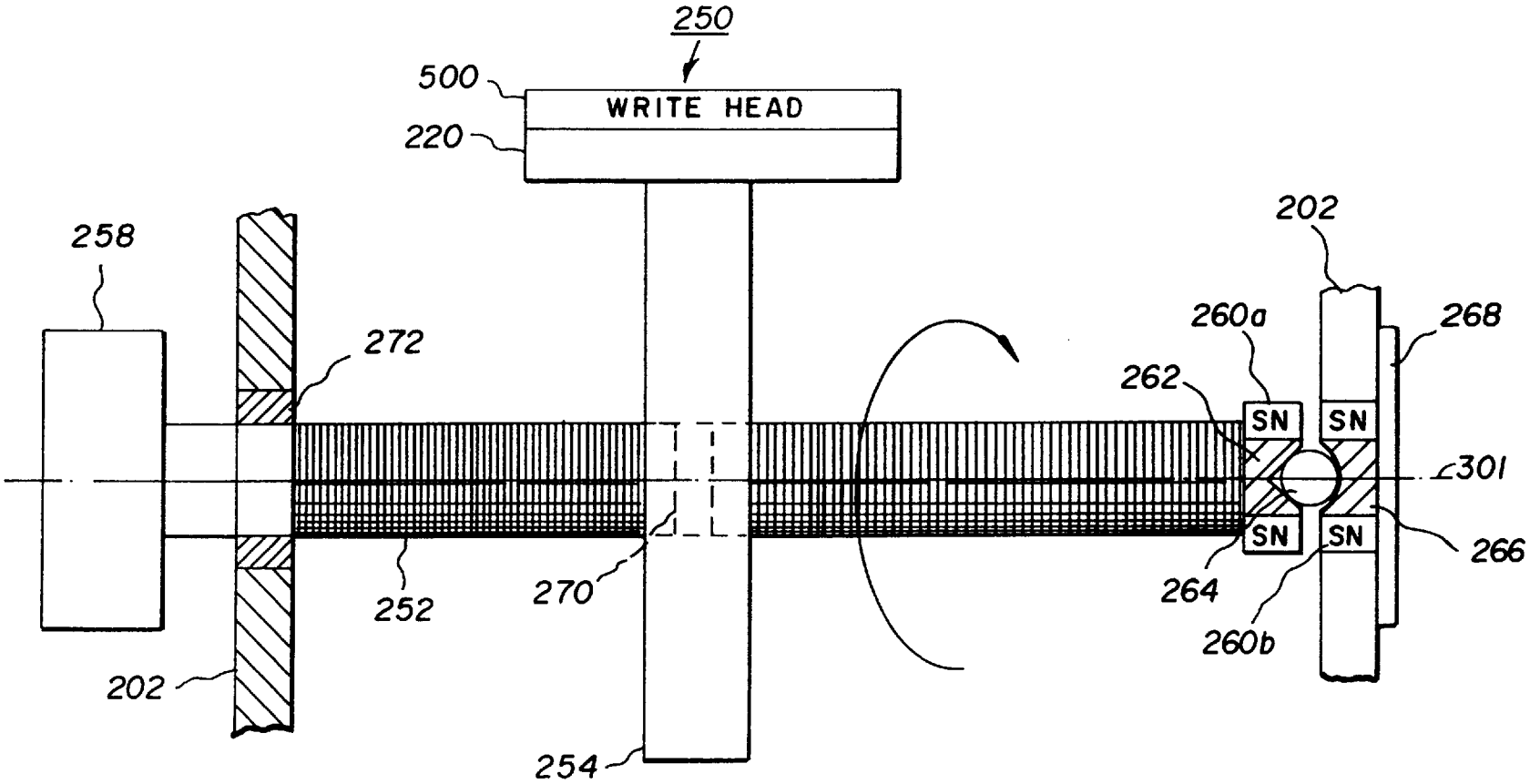
FIG. 3 is a top view in horizontal cross-section, partially in phantom, of a lead screw of the present invention.

Referring to FIGS. 2 and 3, a lead screw 250 is shown which includes an elongated, threaded shaft 252 which is attached to the linear drive motor 258 on its drive end and to the lathe bed scanning frame 202 by means of a radial bearing 272. A lead screw drive nut 254 includes grooves in its hollowed-out center portion 70 for mating with the threads of the threaded shaft 252 for permitting the lead screw drive nut 254 to move axially along the threaded shaft 252 as the threaded shaft 252 is rotated by the linear drive motor 258. The lead screw drive nut 254 is integrally attached to the to the printhead 500 through the lead screw coupling 256 (not shown) and the translation stage member 220 at its periphery so that as the threaded shaft 252 is rotated by the linear drive motor 258 the lead screw drive nut 254 moves axially along the threaded shaft 252 which in turn moves the translation stage member 220 and ultimately the printhead 500 axially along the vacuum imaging drum 300.

As best illustrated in FIG. 3, an annular-shaped axial load magnet **260*a* is integrally attached to the driven end of the threaded shaft 252, and is in a spaced apart relationship with another annular-shaped axial load magnet 260*b* attached to the lathe bed scanning frame 202. The axial load magnets 260*a* and 260*b* are preferably made of rare-earth materials such as neodymium-iron-boron. A generally circular-shaped boss 262 part of the threaded shaft 252 rests in the hollowed-out portion of the annular-shaped axial load magnet 260*a*, and includes a generally V-shaped surface at the end for receiving a ball bearing 264. A circular-shaped insert 266 is placed in the hollowed-out portion of the other annular-shaped axial load magnet 260*b*, and includes an accurate-shaped surface on one end for receiving the ball bearing 264, and a flat surface at its other end for receiving an end cap 268 placed over the annular-shaped axial load magnet 260*b* and attached to the lathe bed scanning frame 202 for protectively covering the annular-shaped axial load magnet 260*b* and providing an axial stop for the lead screw 250. The circular shaped insert 266** is preferably made of material such as Rulon J or Delrin AF, both well known in the art.

The lead screw 250 operates as follows. The linear drive motor 258 is energized and imparts rotation to the lead screw 250, as indicated by the arrows, causing the lead screw drive nut 254 to move axially along the threaded shaft 252. The annular-shaped axial load magnets **260*a* and 260*b* are magnetically attracted to each other which prevents axial movement of the lead screw 250. The ball bearing 264, however, permits rotation of the lead screw 250 while maintaining the positional relationship of the annular-shaped axial load magnets 260, i.e., slightly spaced apart, which prevents mechanical friction between them while obviously permitting the threaded shaft 252** to rotate.

The printhead 500 travels in a path along the vacuum imaging drum 300, while being moved at a speed synchronous with the vacuum imaging drum 300 rotation and proportional to the width of the writing swath 450, not shown. The pattern that the printhead 500 transfers to the thermal print media 32 along the vacuum imaging drum 300, is a helix.

Figure 4:
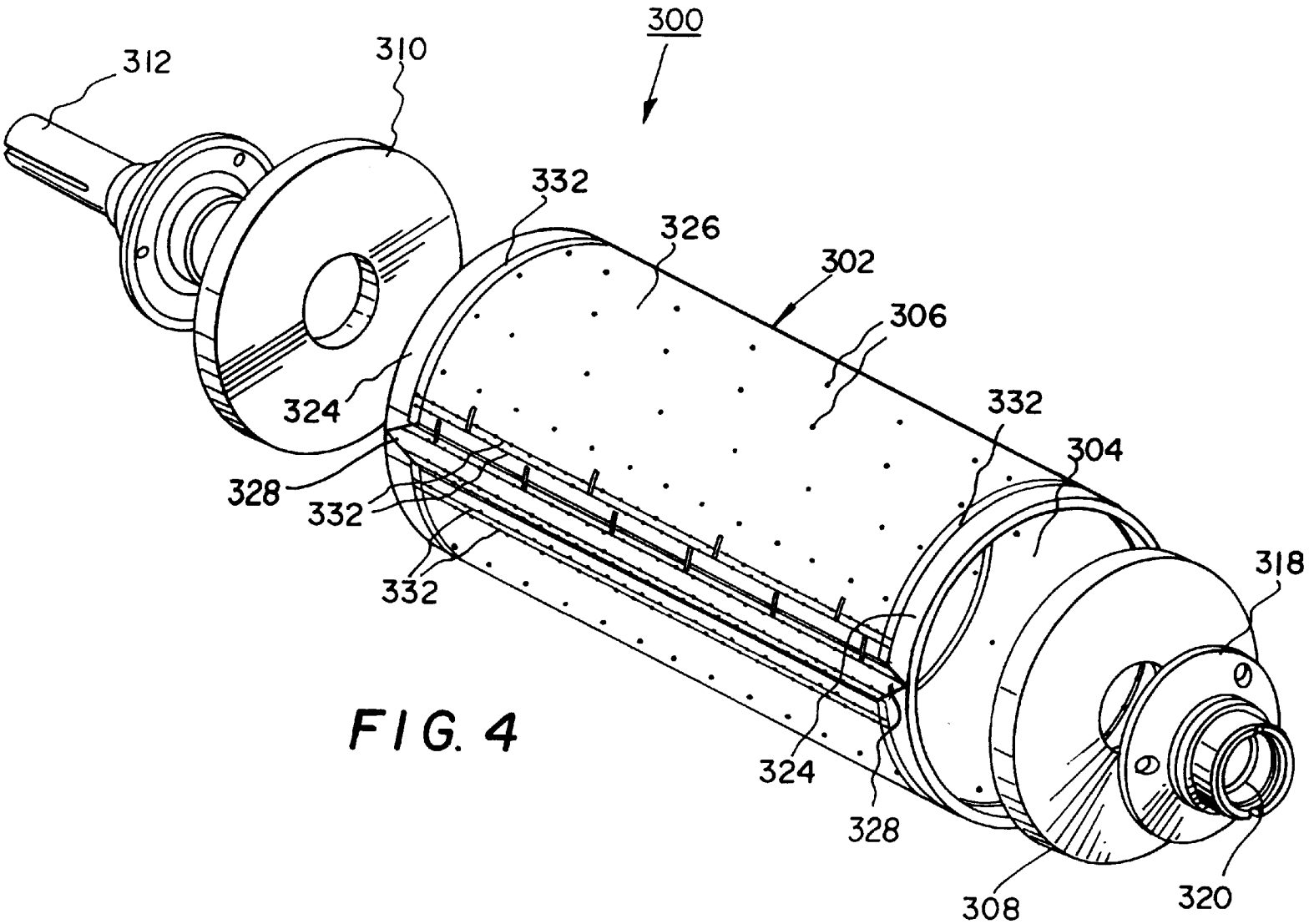
FIG. 4 is a exploded, perspective view of a vacuum imaging drum of the present invention.

Referring to FIG. 4, there is illustrated an exploded view of the vacuum imaging drum 300. The vacuum imaging drum 300 has a cylindrical shaped vacuum drum housing 302 that has a hollowed-out interior portion 304, and further includes a plurality of vacuum grooves 332 and vacuum holes 306 which extend through the vacuum drum housing 302 for permitting a vacuum to be applied from the hollowed-out interior portion 304 of the vacuum imaging drum 300 for supporting and maintaining position of the thermal print media 32, and the dye donor sheet material 36, as the vacuum imaging drum 300 rotates.

The ends of the vacuum imaging drum 300 are closed by the vacuum end plate 308, and the drive end plate 310. The drive end plate 310, is provided with a centrally disposed drive spindle 312 which extends outwardly therefrom through a support bearing 314, the vacuum end plate 308 is provided with a centrally disposed vacuum spindle 318 which extends outwardly therefrom through another support bearing 314.

The drive spindle 312 extends through the support bearing 314 and is stepped down to receive a DC drive motor armature 316 (not shown), which is held on by means of a drive nut 340 (not shown). A DC motor stator 342 is stationary held by the late bed scanning frame member 202, encircling the DC drive motor armature 316 to form a reversible, variable DC drive motor for the vacuum imaging drum 300. At the end of the drive spindle 312 a drum encoder 344 is mounted to provide the timing signals to the image processing apparatus 10.

The vacuum spindle 318 is provided with a central vacuum opening 320 which is in alignment with a vacuum fitting 222 with an external flange that is rigidly mounted to the lathe bed scanning frame 202. The vacuum fitting 222 has an extension which extends within but is closely spaced from the vacuum spindle 318, thus forming a small clearance. With this configuration, a slight vacuum leak is provided between the outer diameter of the vacuum fitting 222 and the inner diameter of the central vacuum opening 320 of the vacuum spindle 318. This assures that no contact exists between the vacuum fitting 222 and the vacuum imaging drum 300 which might impart uneven movement or jitters to the vacuum imaging drum 300 during its rotation.

The opposite end of the vacuum fitting 222 is connected to a high-volume vacuum blower 224 which is capable of producing 50–60 inches of water at an air flow volume of 60–70 cfm. And provides the vacuum to the vacuum imaging drum 300 supporting the various internal vacuum levels of the vacuum imaging drum 300 required during the loading, scanning and unloading of the thermal print media 32 and the dye donor material 36 to create the intended image. With no media loaded on the vacuum imaging drum 300 the internal vacuum level of the vacuum imaging drum 300 is approximately 10–15 inches of water. With just the thermal print media 32 loaded on the vacuum imaging drum 300 the internal vacuum level of the vacuum imaging drum 300 is approximately 20–25 inches of water this level is required such that when a dye donor sheet material 36 is removed. The thermal print media 32 does not move otherwise color to color registration will be able to be maintained. With both the thermal print media 32 and dye donor sheet material 36 completely loaded on the vacuum imaging drum 300 the internal vacuum level of the vacuum imaging drum 300 is approximately 50–60 inches of water in this configuration.

Figure 5:
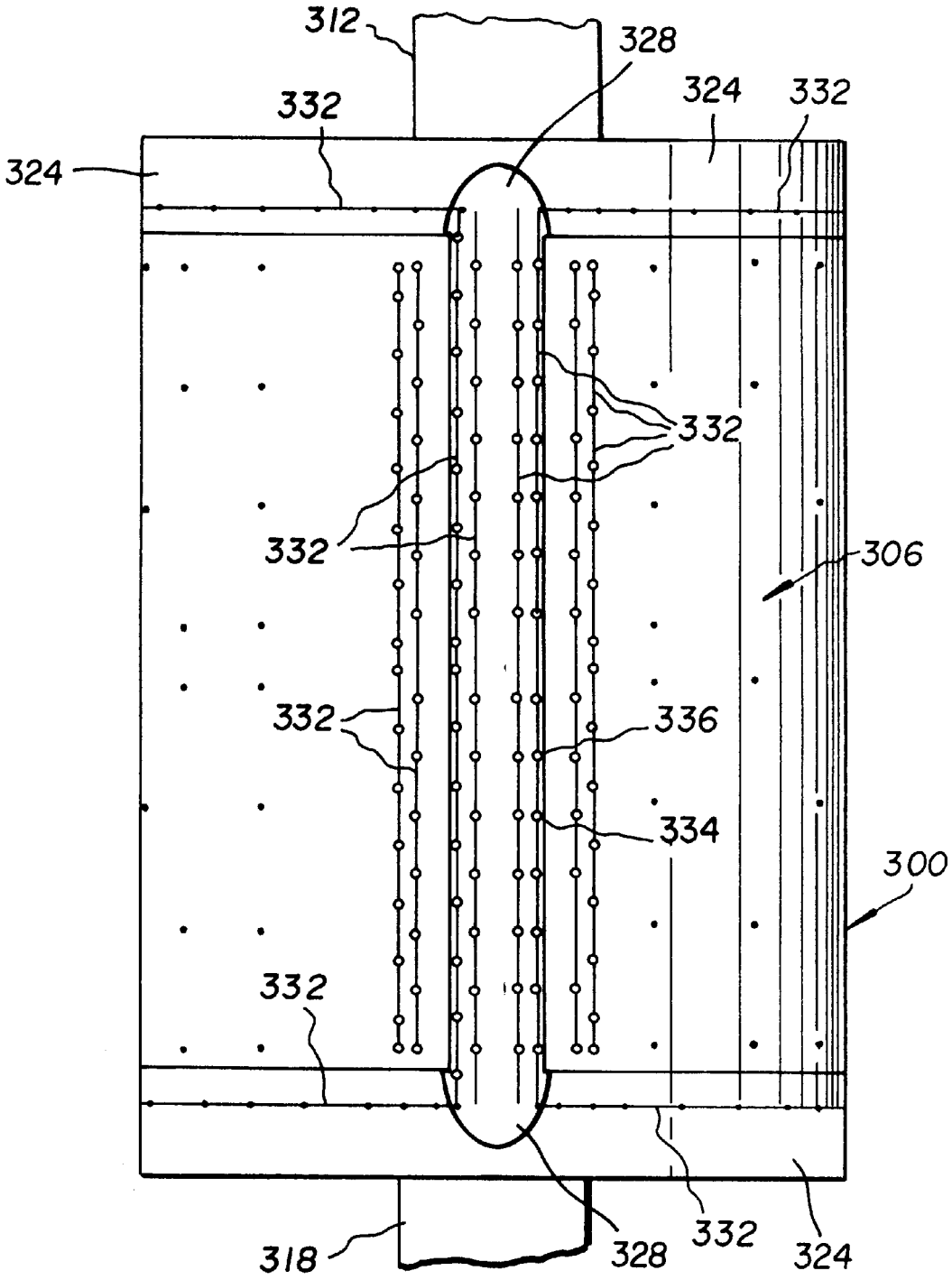
FIG. 5 is a plane view of a surface of a surface of the vacuum imaging drum of the present invention.

The outer surface of the vacuum imaging drum 300 is provided with an axially extending flat 322 (as shown FIG. 5), which extends approximately 8 degrees of the vacuum imaging drum 300 circumference. The vacuum imaging drum 300 is also provided with donor support rings 324 which form a circumferential recess 326 which extends circumferentially from one side of the axially extending flat 322 circumferentially around the vacuum imaging drum 300 to the other side of the axially extending flat 322, and from approximately one inch from one end of the vacuum imaging drum 300 to approximately one inch from the other end of the vacuum imaging drum 300.

Figure 6A:
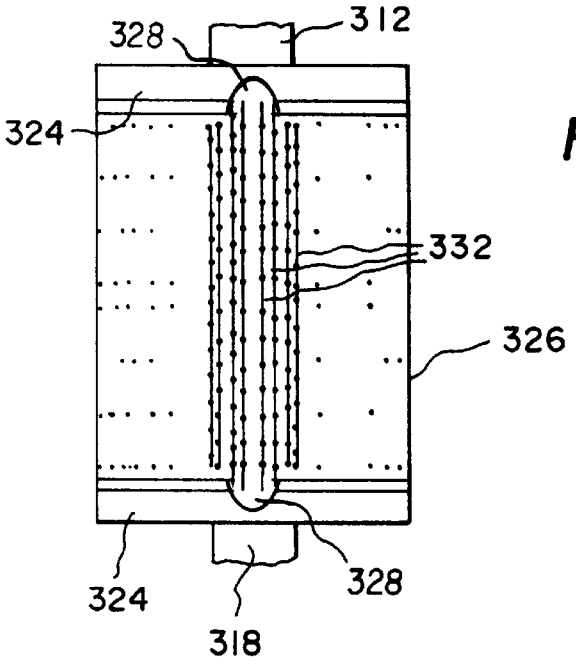
FIGS. 6*a*–6*c* plane view of the vacuum imaging drum showing the sequence of placement for the thermal print media and dye donor sheet material.
Figure 6B:
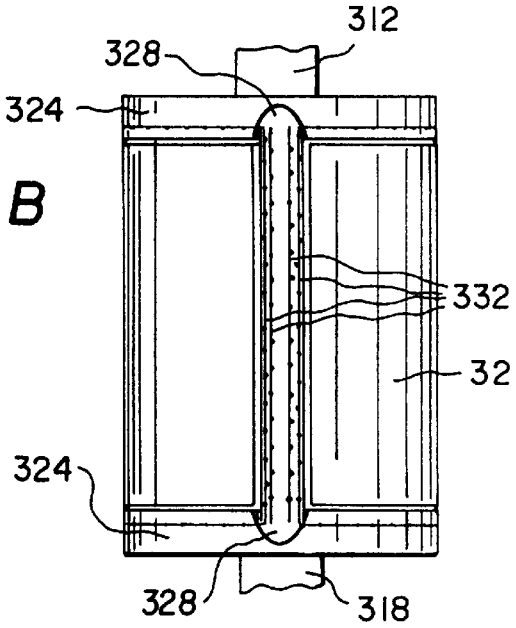
Figure 6C:
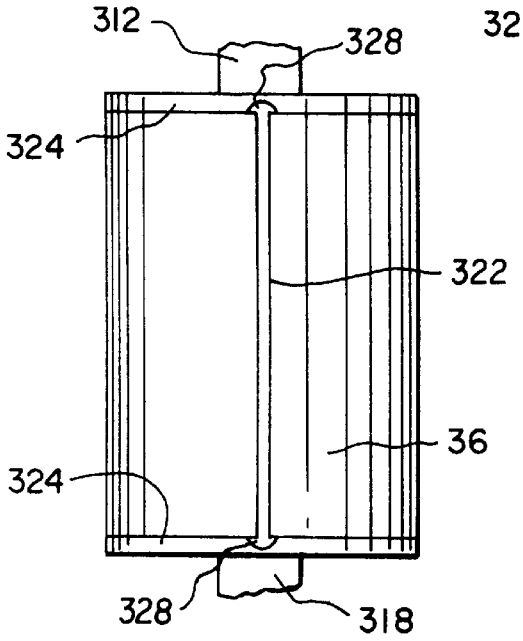

The thermal print media 32 when mounted on the vacuum imaging drum is seated within the circumferential recess 326, as shown in FIGS. 6*a*–6*c*. The donor support rings 324 have a thickness substantially equal to the thickness of thermal print media 32, approximately 0.004 inches. In one embodiment, donor support rings are movable axially to accommodate different sizes of thermal print media. The purpose of the circumferential recess 326 on the vacuum imaging drum 300 surface is to eliminate any creases in the dye donor material 36, as it is drawn down over the thermal print media 32 during the loading of the dye donor material 36. This ensures that no folds or creases will be generated in the dye donor sheet material 36 which could extend into the image area and seriously adversely affect the intended image. The circumferential recess 326 also substantially eliminates the entrapment of air along the edge of the thermal print media 32, where it is difficult for the vacuum holes 306 in the vacuum imaging drum 300 surface to assure the removal of the entrapped air. Any residual air between the thermal print media 32 and the dye donor sheet material 36, can also adversely affect the intended image.

Formed in the donor support rings 324 at the ends of the axially extending flat 322 are media contours 328. The axially extending flat 322 and the media contours 328 are somewhat the same, they assure that the leading and trailing ends of the dye donor material 36 are protected from the effect of increased air turbulence during the relatively high speed rotation that the vacuum imaging drum 300 undergoes during the image scanning process. Thus increased air turbulence will have less tendency to lift or separate the leading or trailing edges of the dye donor sheet material 36 off from the vacuum imaging drum 300, also the axially extending flat 322 and the media contours 328 ensure that the leading and trailing ends of the dye donor sheet material 36 are recessed from the vacuum imaging drum 300 periphery. This reduces the chance that the dye donor sheet material 36 can come in contact with other parts of the image processing apparatus 10, such as the printhead 500, this could cause a media jam within the image processing apparatus, resulting in the possible loss of the intended image or at worse catastrophic damage to the image processing apparatus 10 possibly damaging the printhead 500.

The media contours 328 support the corners of the dye donor material 36 as the dye donor material 36 is drawn down on the vacuum imaging drum, preventing flutes or air under the corners of the dye donor material 36 and insuring full contact with the vacuum imaging drum 300 surface. In the absence of media contour 328, a flute would be formed due to the interface of dye donor material 36, thermal print media 32, axially extending flat 322, and circumferential recess 326 which would cause both the thermal print media 32 and dye donor sheet material 36 to lift or separate off from the vacuum imaging drum 300.

Figure 7:
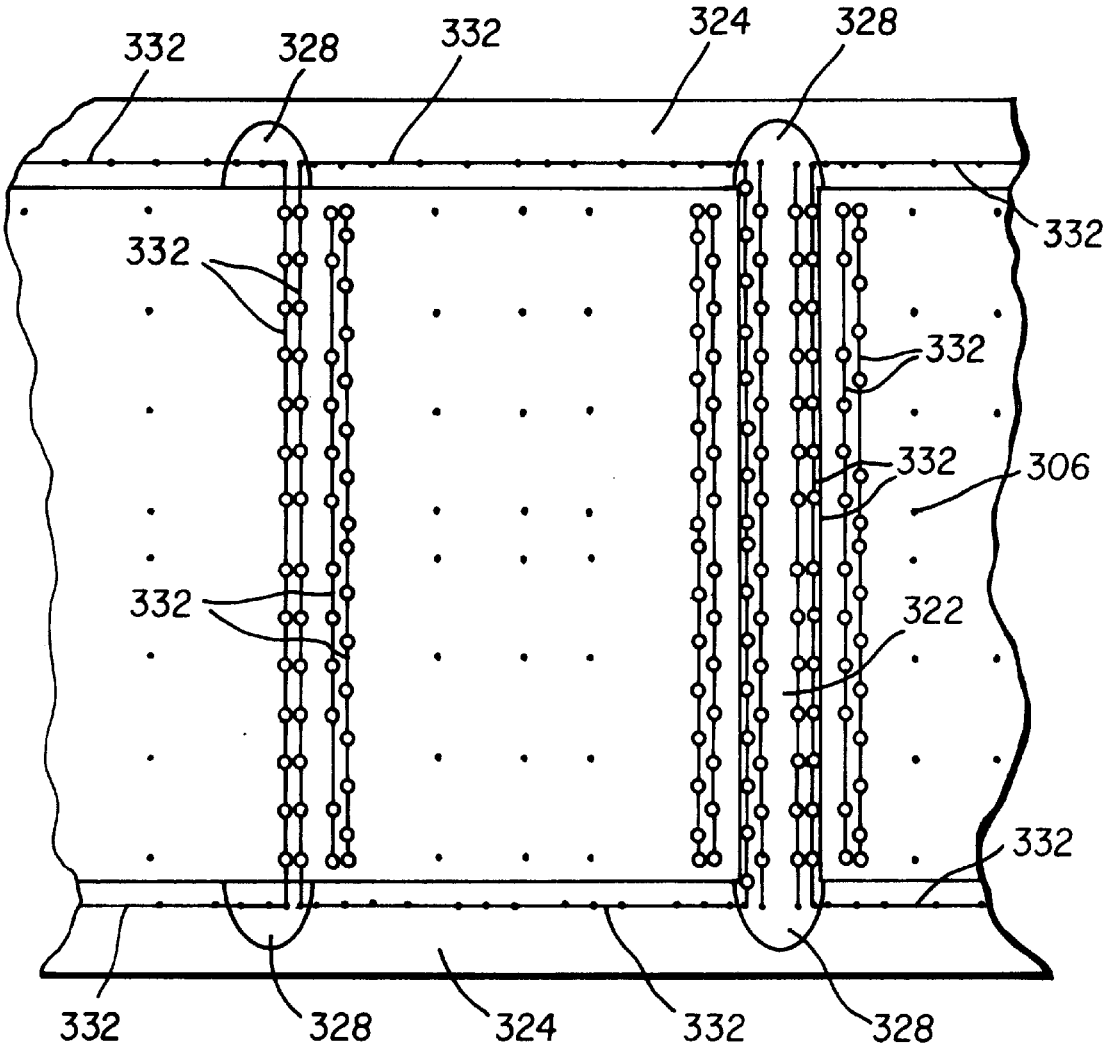
FIG. 7 is a plane view of the vacuum imaging drum showing donor support rings with a plurality of media contours to accommodate different lengths of the dye donor sheet material and the thermal print media on the same drum.

Referring to FIG. 7, there is illustrated a plane view of the surface of the vacuum imaging drum 300 showing the media contours 328 used in multiple positions on the donor support rings 324 to provide the use of different lengths of the thermal print media 32 and dye donor sheet material 36 on the same drum 300.

Figure 8:
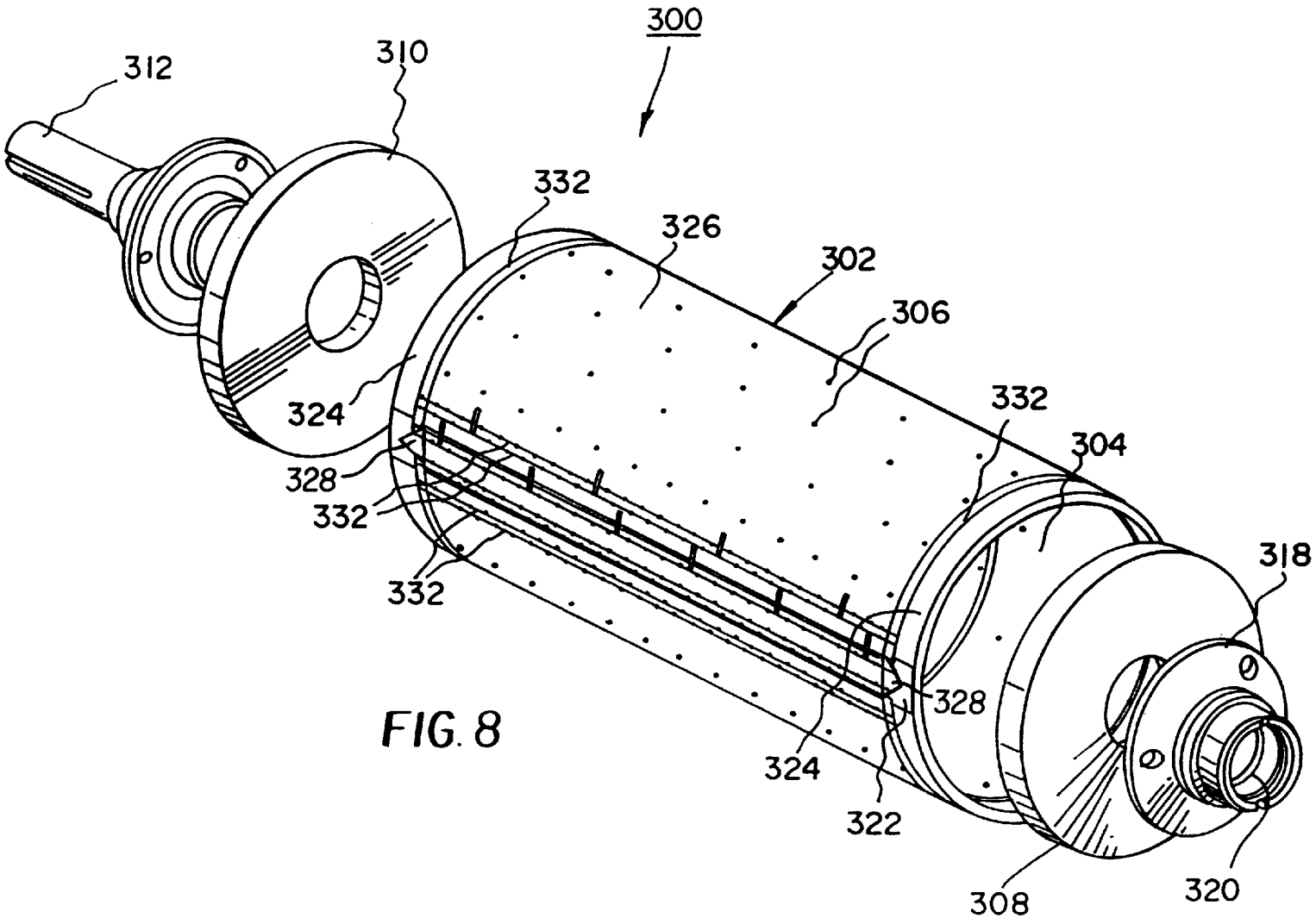
FIG. 8 is a exploded, perspective view of an alternate embodiment of a vacuum imaging drum without an axially extending flat.

Referring to FIG. 8, there is illustrated an exploded, perspective view of the vacuum imaging drum 300 utilizing the media contours 328 of the present invention with no axially extending flat 322.

Figure 9:
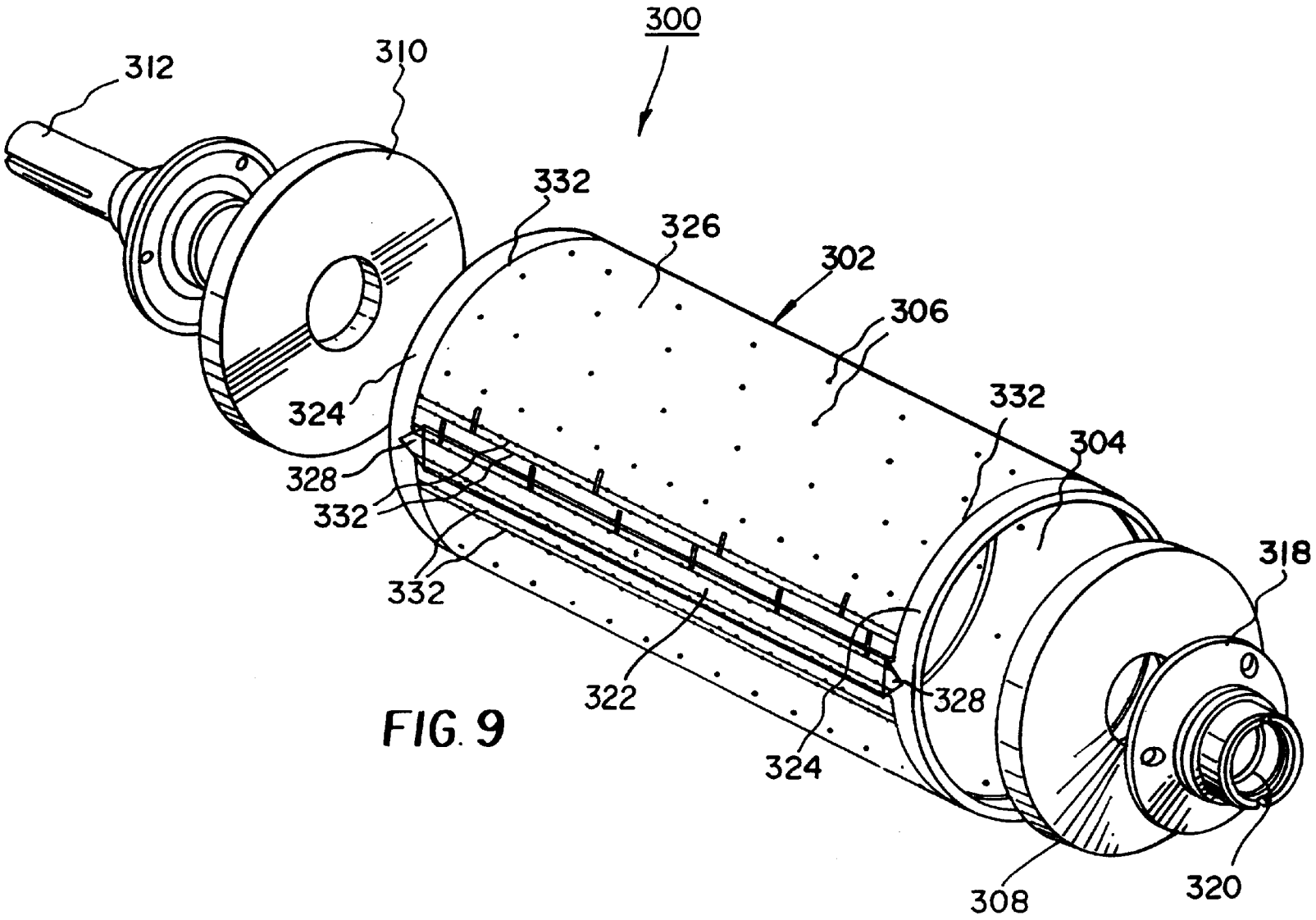
FIG. 9 is a exploded, perspective view of yet another embodiment of a vacuum imaging drum with a single sheet of thermal print media and an axially extending flat.

Referring to FIG. 9, there is illustrated an exploded, perspective view of the vacuum imaging drum 300 utilizing the media contours 328 of the present invention arranged to hold a single sheet of thermal print media 32 with no donor support rings 324. The media contours 328 are formed in the surface of the vacuum imaging drum 300. The media contours 328 are at the opposed ends of axially extending flat 322.

Figure 10:
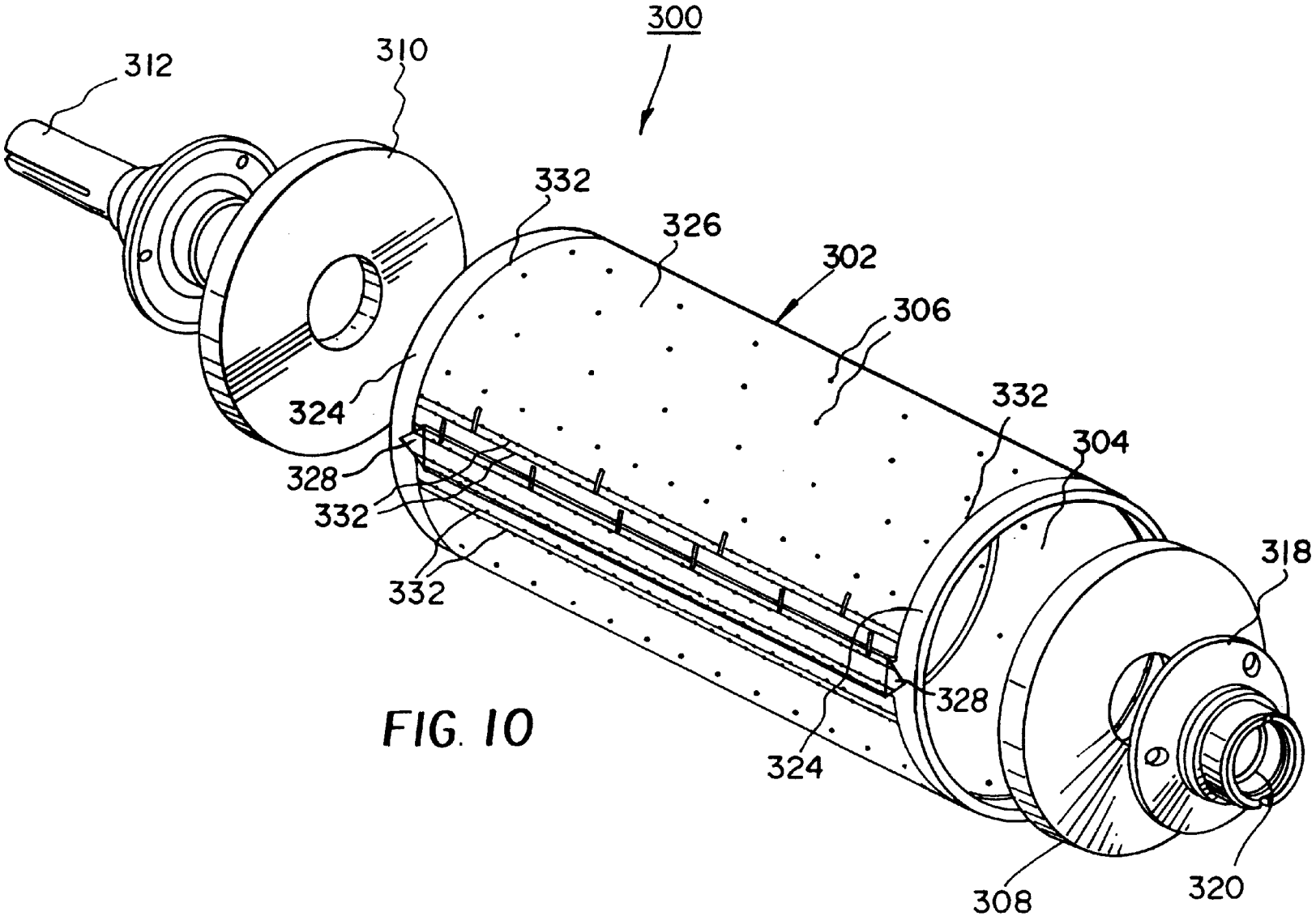
FIG. 10 is a exploded, perspective view of a vacuum imaging drum for a single sheet of thermal print media without axially extending flat utilizing area and the present invention.

Referring to FIG. 10, there is illustrated an exploded, perspective view of the vacuum imaging drum 300 utilizing the media contours 328 of the present invention arranged to hold a single sheet of thermal print media 32 without donor support rings 324. In this embodiment, an axially extending flat 322 is not used. The media contours 328 are formed in the surface of the vacuum imaging drum 300.

Figure 11:
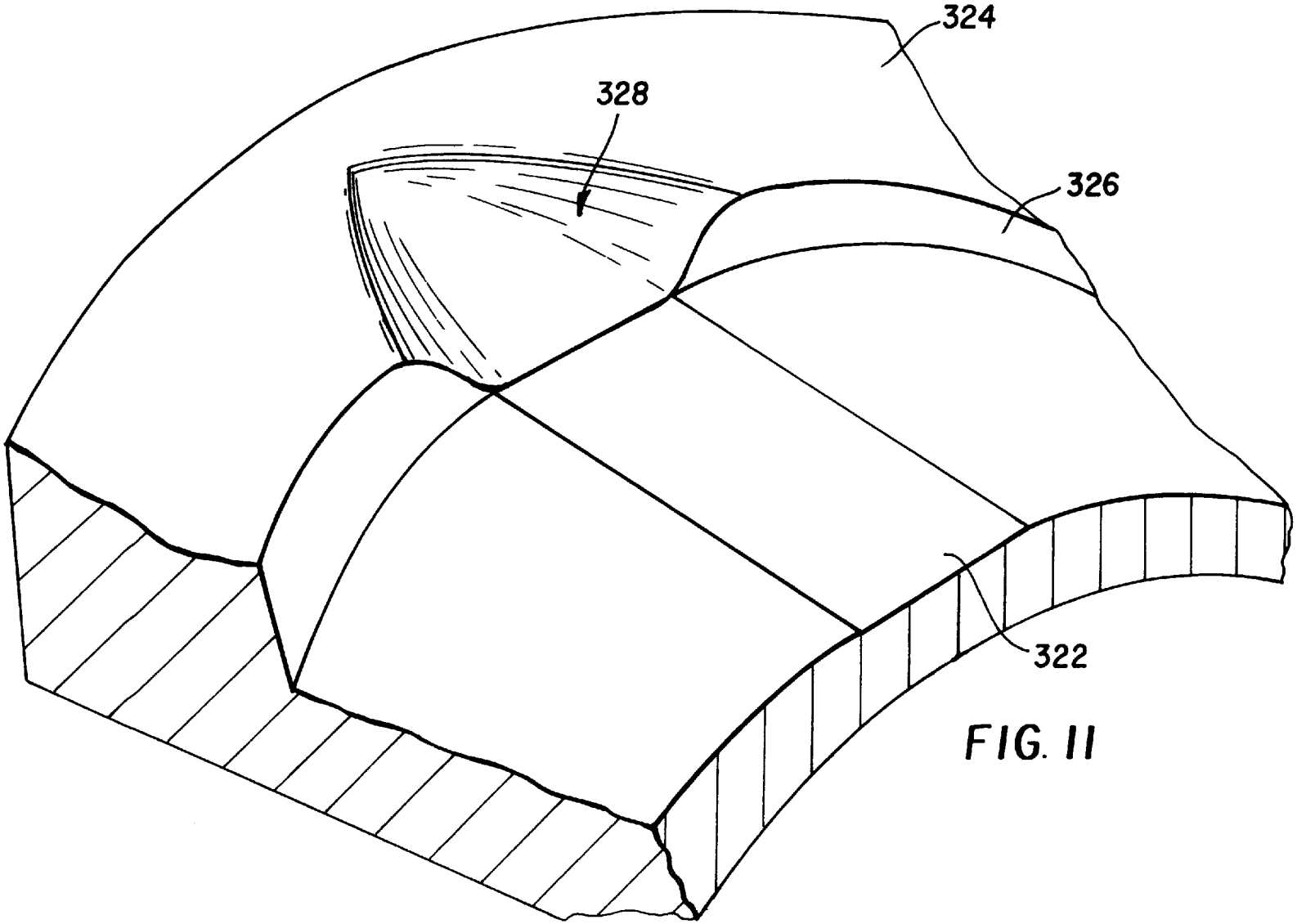
FIG. 11 is a perspective view partially in section of a vacuum imaging drum according to the present invention showing a media contour.
Figure 12:
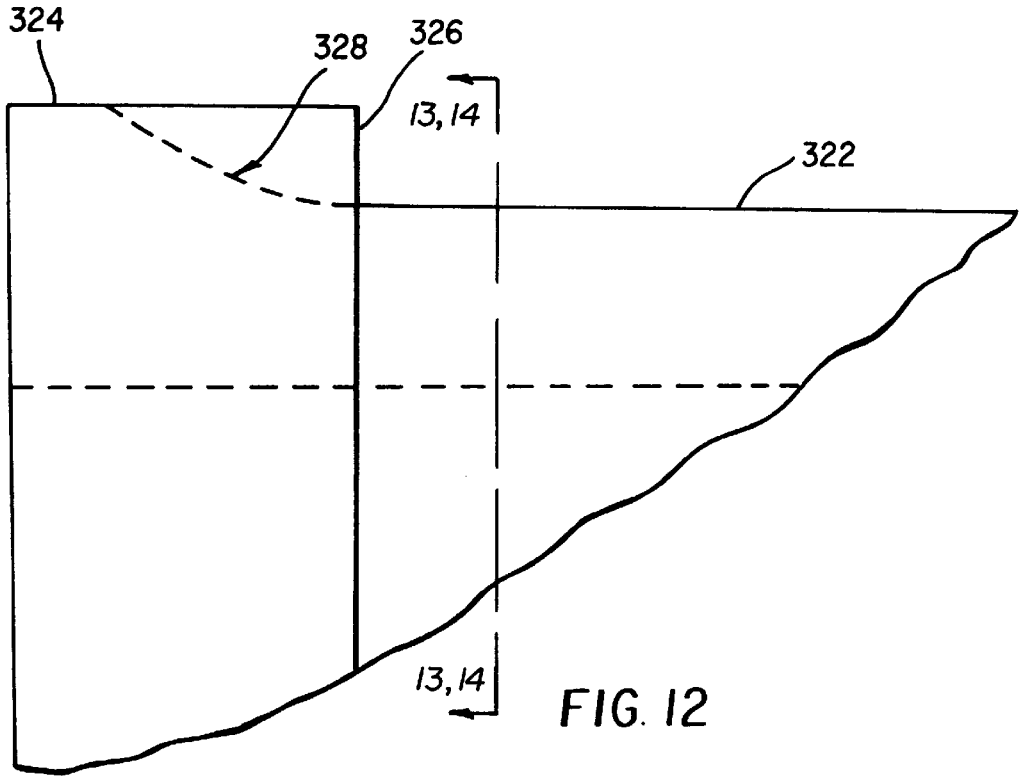
FIG. 12 is a plan view, partially in phantom, of a section of the vacuum imaging drum shown in FIG. 11.
Figure 13:
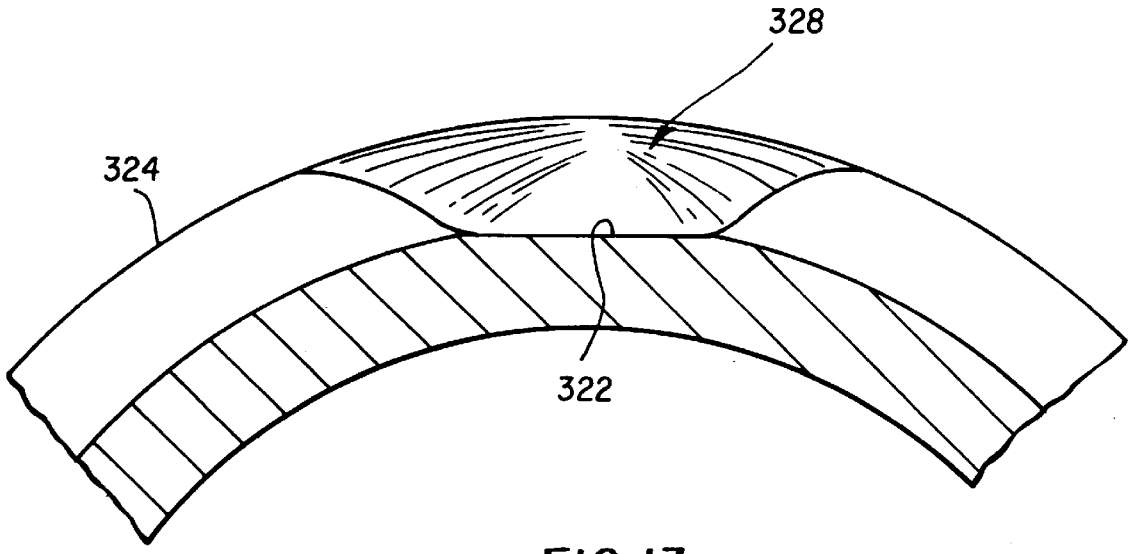
FIG. 13 is a section view along line 13,14—13,14 of FIG. 12 with the media contour configured to accommodate a flute formed on a dye donor sheet.
Figure 14:
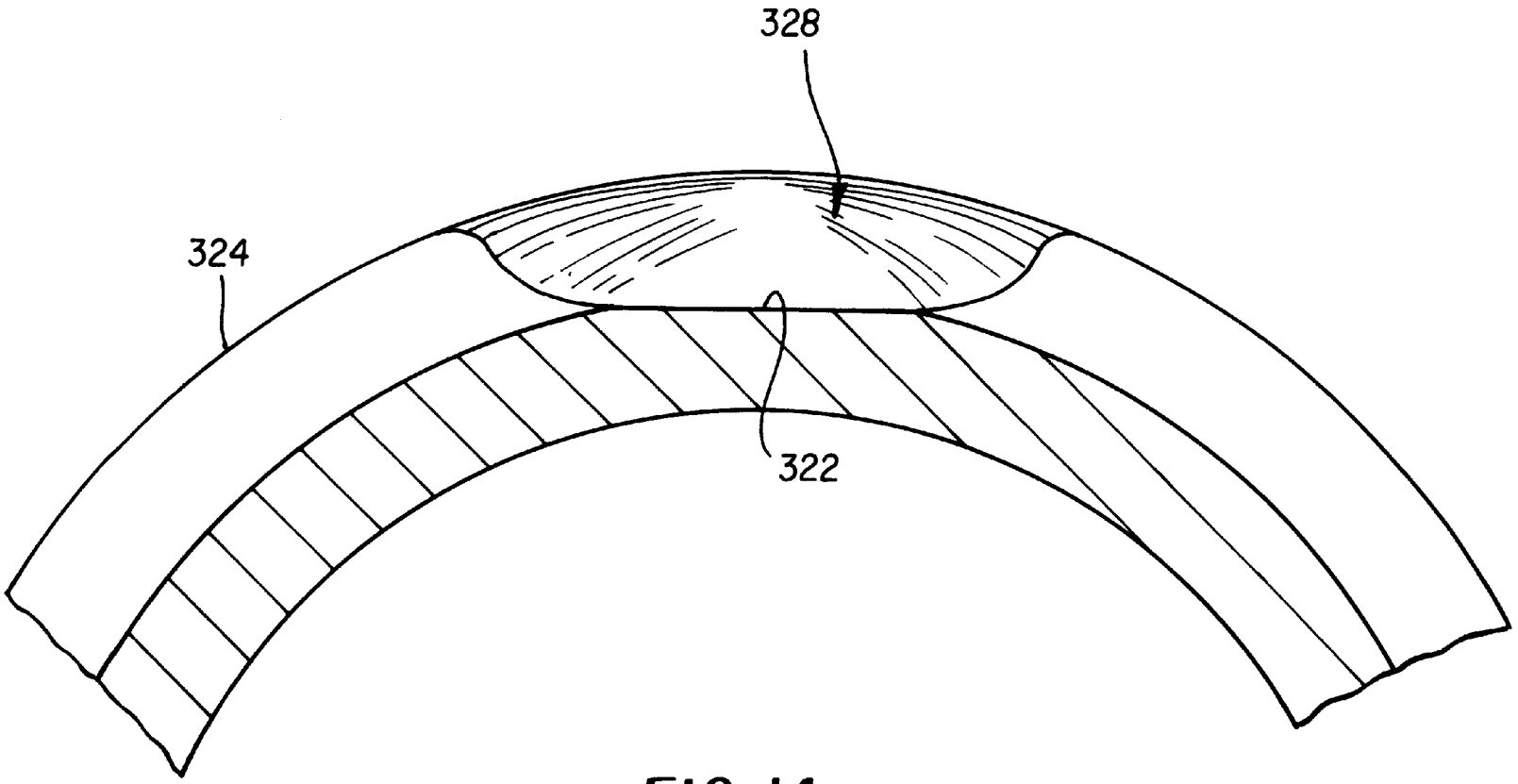
FIG. 14 is a sectional view of an alternate embodiment along line 13,14—13,14 of FIG. 12 with the media contour to reverse a flute formed in a dye donor sheet.

FIG. 11 shows a perspective view partially in section of a vacuum imaging drum showing the media contour 328 formed in donor support ring 324. The media contour 328 is at one end of axially extending flat 322. A similar media contour is found at the opposite end of the axially extending flat. FIG. 12 shows media contour 328 in phantom as a gradually extending slope in an axial direction starting circumferential recess 326, extending upward to the surface of donor support ring 324. FIG. 13 shows an end view of media contour 328 having a profile which is approximately concave at the edges. This configuration allows the naturally forming flute in a corner of the dye donor material to be pressed flat against the shape of the shoulder on the media contour 328. FIG. 14 shows an alternate embodiment wherein the edges of the media contour 328 are predominately concave. This configuration forces a reverse of the flute formed in the corners of the dye donor material.

Figure 15:
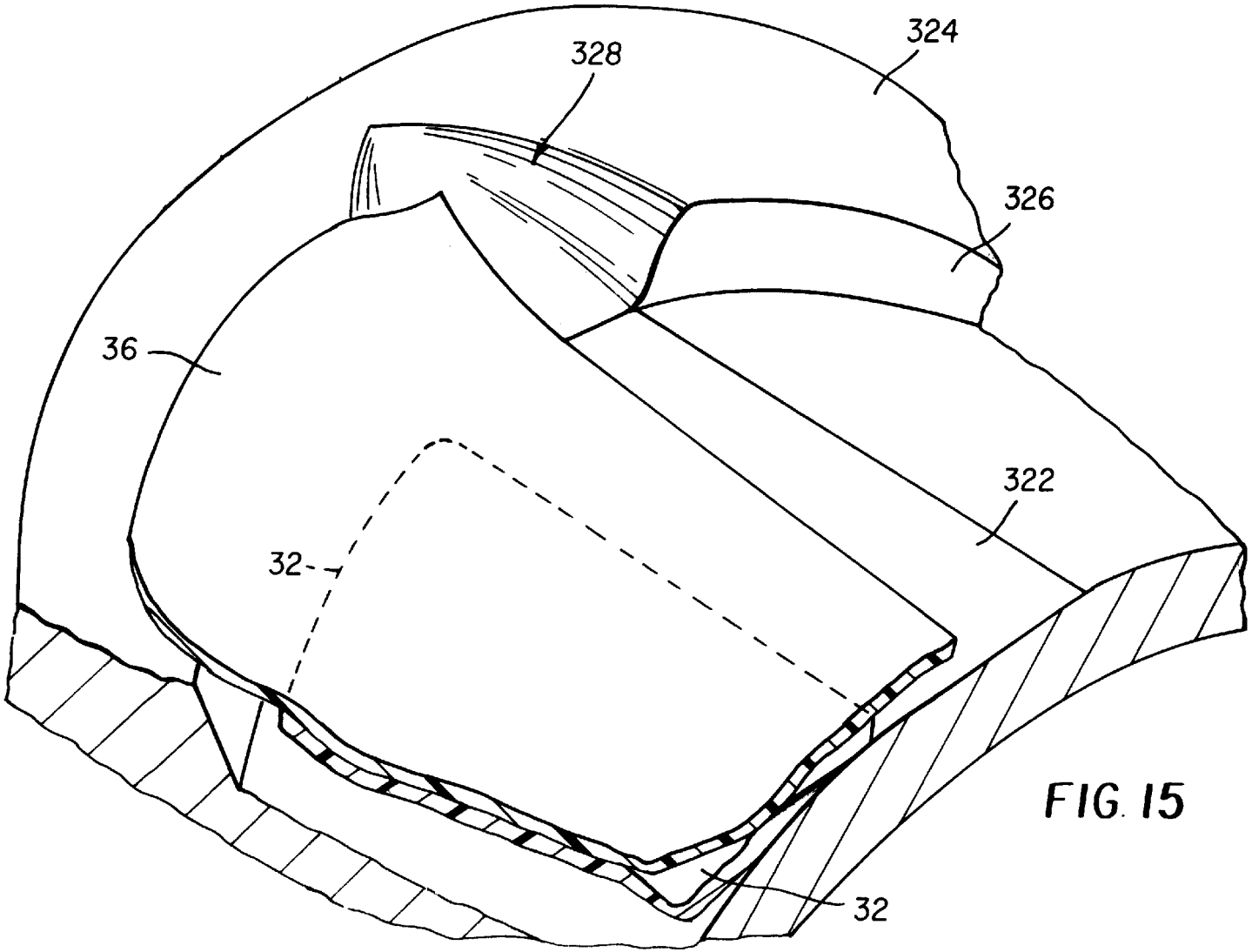
FIG. 15 shows a perspective view partially in section of a vacuum imaging drum according to the present invention showing a corner of a dye donor sheet being formed by the media contour.

FIG. 15 shows a perspective view of a section of the vacuum imaging drum showing the arrangement of the thermal print media 32 overlaid with the dye donor material 36. As the leading edge of dye donor material 36 is drawn down on axial extending flat 322, a flute would tend to form at a corner of dye donor material 36. Media contour 328 prevents the flute from forming.

The invention has been described with reference to the preferred embodiment thereof. However, it will be appreciated and understood that variations and modifications can be effected within the spirit and scope of the invention as described herein above and as defined in the appended claims. by a person of ordinary skill in the art without departing from the scope of the invention. For example, the invention is applicable to any drum. Also, the dye donor may have dye, pigments, or other material which is transferred to the thermal print media. Thermal print media includes paper, films, plates, and other material capable of accepting or producing an image.

Parts List

10. Image processing apparatus
12. Image processor housing
14. Image processor door
16. Donor ejection chute
18. Donor waste bin
20. Media stop
32. Thermal print media
34. Dye donor roll material
36. Dye donor sheet material
50. Sheet material trays
50*a*. Lower sheet material tray
50*b*. Upper sheet material tray
52. Media lift cams
52*a*. Lower media lift cam
52*b*. Upper media lift cam
54. Media rollers
54*a*. Lower media roller
54*b*. Upper media roller
56. Media guide
58. Media guide rollers
60. Media staging tray
80. Transport mechanism
100. Media carousel
110. Media drive mechanism
112. Media drive rollers
120. Media knife assembly
122. Media knife blades
180. Color binding assembly
182. Media entrance door
184. Media exit door
200. Lathe bed scanning subsystem
202. Lathe bed scanning frame
204. Entrance passageway
206. Rear translation bearing rod
208. Front translation bearing rod
220. Translation stage member
222. Vacuum fitting
224. Vacuum blower
250. Lead screw
252. Threaded shaft
254. Lead screw drive nut
256. Drive coupling
258. Linear drive motor
260. Axial load magnets
260*a*. Axial load magnet
260*b*. Axial load magnet
262. Circular-shaped boss
264. Ball bearing
266. Circular-shaped insert
268. End cap
270. Hollowed-out center portion
300. Vacuum imaging drum
302. Vacuum drum housing
304. Hollowed out interior portion
306. Vacuum hole
308. Vacuum end plate
310. Drive end plate
312. Drive spindle
314. Support bearing
316. DC drive motor armature
318. Vacuum spindle
320. Central vacuum opening
322. Axially extending flat
324. Donor support ring
326. Circumferential recess
328. Media contours
332. Vacuum grooves
344. Drum encoder
400. Laser assembly
402. Lasers diode

404. Fiber optic cables
406. Distribution block
450. Writing swath
454. Optical centerline
500. Printhead

What is claimed is:

1. A vacuum imaging drum, mounted for rotation about an axis, for holding a sheet of thermal print media in registration with a sheet of dye donor material comprising:

a circumferential recess on a surface of said drum, wherein said recess is approximately equal to a first length, a first width, and a first height of said sheet of thermal print media, wherein said sheet of thermal print media fits into said recess;

a first donor support ring and a second donor support ring on said surface of said drum, forming a first edge and a second edge of said recess;

an axially extending flat on said surface of said drum wherein a first leading edge of said thermal print media and a first trailing edge of said thermal print media are adjacent said axially extending flat;

a first media contour in said first donor support ring and a second media contour in said second donor support ring, wherein said first media contour is at a first end of said axially extending flat and said second media contour is at a second end of said axially extending flat; and wherein said first media contour bends a first corner of said dye donor material, and said second contour bends a second corner of said dye donor material, to prevent fluting of said dye donor material.

2. A vacuum imaging drum as in claim 1 wherein said thermal print media is held to said surface by a vacuum applied to a series of holes in said surface.

3. A vacuum imaging drum as in claim 1 wherein said dye donor material is held to said first donor support ring and said second donor support ring by a vacuum applied to a series of holes in said support rings.

4. A vacuum imaging drum as in claim 1 wherein a second leading edge and a second trailing edge of said dye donor material are held to said axially extending flat by a vacuum applied to a series of holes in said axially extending flat.

5. A vacuum imaging drum as in claim 1 wherein said first and said second contour are concave.

6. A vacuum imaging drum as in claim 1 wherein said first contour is concave and said second contour is convex.

7. An image processing apparatus for writing images to a thermal print media mounted in registration with a dye donor material on a vacuum imaging drum, comprising:

a printhead having a plurality of light sources;

a lead screw for moving said printhead in a direction approximately parallel to an axis of rotation of said vacuum imaging drum;

wherein said vacuum imaging drum has:

a first donor support ring at a first end and a second donor support ring at a second end of said drum said dye donor material, a circumferential recess formed by said first and said second donor rings for holding said thermal media, an axially extending flat on a surface of said drum extending from said first donor support ring to said second support ring, a first media contour in said first donor support ring at a first end of said axially extending flat and a second media contour in said second donor support ring at a second end of said axially extending flat; and a motor for rotating said vacuum imaging drum.

8. An image processing apparatus according to claim 7, wherein said circumferential recess contains a first set of vacuum openings.

9. An image processing apparatus according to claim 7, wherein said circumferential recess has a depth substantially equal to the thickness of the thermal print media.

10. An image processing apparatus according to claim 7, wherein said imaging drum diameter, media contours, and width of the axially extending flat, are arranged so that both a leading and a trailing edge of said dye donor material overlie opposite sides of the contoured ends and opposite edges of said axial extending flat area without overlapping each other.

11. An image processing apparatus according to claim 7, wherein said donor support rings and said media contours are movable along the axis of said vacuum imaging drum to accommodate multiple sizes of thermal print media and dye donor sheet material.

12. An image processing apparatus according to claim 11, wherein said donor support rings have a plurality of said media contours arranged around the circumference to support multiple sizes of thermal print media and dye donor materials.

13. An image processing apparatus according to claim 7, wherein said media contours are concave.

14. An image processing apparatus according to claim 7, wherein said media contours are convex.

15. An imaging drum according to claim 7, wherein said donor support rings have a plurality of media contours arranged around the circumference to support multiple sizes of thermal print media and dye donor sheet material.

16. An image processing apparatus according to claim 7, wherein said donor support rings have a plurality of said media contours arranged around the circumference to support multiple sizes of thermal print media and dye donor materials.

17. An image processing apparatus according to claim 7, wherein said thermal print media is covered by a dye donor.

18. An image processing apparatus according to claim 7, wherein said vacuum imaging drum has at least one vacuum groove is in said surface.

19. An image processing apparatus according to claim 7, wherein said image processing apparatus is a color proffer.

20. An image processing apparatus according to claim 7, wherein said image processing apparatus is a laser thermal printer.

21. An image processing apparatus according to claim 7, wherein said dye donor material overlays said thermal print media and said printhead writes an image to said thermal print media by transferring a color from said dye donor sheet material to said thermal print media.

22. An image processing apparatus for writing images to a thermal print media mounted in registration with a dye donor material on a vacuum imaging drum, comprising:

a printhead having a plurality of light sources;

a lead screw for moving said printhead in a direction approximately parallel to an axis of rotation of said vacuum imaging drum;

wherein said vacuum imaging drum has:

a first donor support ring at a first end of said drum and a second donor support ring at a second end of said drum wherein said support rings hold said dye donor material, a circumferential recess formed by said first and said second donor rings for holding said thermal media, a first media contour in said first donor support and a second media contour in said second donor support; and a motor for rotating said vacuum imaging drum.

23. An image processing apparatus according to claim 22, wherein said circumferential recess contains a plurality of vacuum openings in said vacuum imaging drum.

24. An image processing apparatus according to claim 22, wherein said circumferential recess has a depth substantially equal to the thickness of the thermal print media.

25. An image processing apparatus according to claim 22, wherein said donor support rings and said media contours are movable along the axis of said vacuum imaging drum to accommodate multiple sizes of thermal print media and dye donor materials.

26. An image processing apparatus according to claim 22, wherein said contoured ends are concave.

27. An image processing apparatus according to claim 22, wherein said contoured ends are convex.

28. An image processing apparatus according to claim 22, wherein said vacuum imaging drum has at least one vacuum groove is in said surface.

29. An image processing apparatus according to claim 22, wherein a plurality of laser diodes is connected to said printhead by a plurality of fiber-optics to produce said light source.

30. An image processing apparatus according to claim 22, wherein said image processing apparatus is a color proofer.

31. An image processing apparatus according to claim 22, wherein said image processing apparatus is a laser thermal printer.

32. An image processing apparatus according to claim 22, wherein a donor overlays said thermal print media and said printhead writes an image to said thermal print media by transferring a color from said dye donor sheet material to said thermal print media.

33. An image processing apparatus for writing images to a thermal print media comprising:

a printhead having a plurality of light sources;

a lead screw for moving said printhead in a first direction;

a vacuum imaging drum;

thermal print media mounted on said vacuum imaging drum;

a motor for rotating said vacuum imaging drum; and wherein said vacuum imaging drum has media contours formed in the surface of the vacuum imaging drum at the ends of axially extending flat.

34. An image processing apparatus according to claim 33, wherein said imaging drum diameter, media contours and width of the axially extending flat, are arranged so that both a leading and a trailing edge of a dye donor material overlie opposite sides of the media contours without overlapping each other.

35. An image processing apparatus according to claim 33, wherein said contoured ends are concave.

36. An image processing apparatus according to claim 33, wherein said contoured ends are convex.

37. An imaging drum according to claim 33, wherein said donor support rings have multiple said media contours arranged around the circumference to support multiple sizes of thermal print media and dye donor materials.

38. An image processing apparatus according to claim 33, wherein said donor support rings have multiple said media contours arranged around the circumference to support multiple sizes of thermal print media and dye donor materials.

39. An image processing apparatus according to claim 33, wherein said vacuum imaging drum has multiple said media contours arranged around the circumference to support multiple sizes of thermal print media and dye donor materials.

40. An image processing apparatus according to claim 33, wherein said thermal print media is covered by a dye donor sheet material.

41. An image processing apparatus according to claim 33, wherein said vacuum imaging drum has at least one vacuum hole in said surface.

42. An image processing apparatus according to claim 33, wherein said vacuum imaging drum has at least one vacuum groove is in said surface.

43. An image processing apparatus according to claim 33, wherein a plurality of laser diodes are connected to said printhead by a plurality of fiber-optics to produce said light source.

44. An image processing apparatus according to claim 33, wherein said image processing apparatus is a color proofer.

45. An image processing apparatus according to claim 33, wherein said image processing apparatus is a laser thermal printer.

46. An image processing apparatus according to claim 33, wherein a dye donor material overlays said thermal print media and said printhead writes an image to said thermal print media by transferring a color from said dye donor material to said thermal print media.

47. An image processing apparatus for writing images to a thermal print media comprising:

a printhead having a plurality of light sources;

a lead screw for moving said printhead in a first direction;

a vacuum imaging drum;

thermal print media mounted on said vacuum imaging drum;

a motor for rotating said vacuum imaging drum; and wherein said vacuum imaging drum has media contours formed in the surface of the vacuum imaging drum.

48. An image processing apparatus according to claim 47, wherein said imaging drum diameter, media contours, are arranged so that both the leading and trailing edge of said dye donor sheet material overlie the opposite sides of the media contours without overlapping each other.

49. An image processing apparatus according to claim 47, wherein said contoured ends are concave.

50. An image processing apparatus according to claim 47, wherein said contoured ends are convex.

51. An image processing apparatus according to claim 47, wherein said donor support rings have multiple said media contours arranged around the circumference to support multiple sizes of thermal print media and dye donor materials.

52. An image processing apparatus according to claim 47, wherein said donor support rings have multiple said media contours arranged around the circumference to support multiple sizes of thermal print media and dye donor materials.

53. An image processing apparatus according to claim 47, wherein said vacuum imaging drum has multiple said media contours arranged around the circumference to support multiple sizes of thermal print media and dye donor materials.

54. An image processing apparatus according to claim 47, wherein said thermal print media is covered by a dye donor sheet material.

55. An image processing apparatus according to claim 47, wherein said vacuum imaging drum has at least one vacuum hole is in said surface.

56. An image processing apparatus according to claim 47, wherein said vacuum imaging drum has at least one vacuum groove is in said surface.

57. An image processing apparatus according to claim 47, wherein a plurality of laser diodes is connected to said printhead by a plurality of fiber-optics to produce said light source.

58. An image processing apparatus according to claim 47, wherein said image processing apparatus is a color proofer.

59. An image processing apparatus according to claim 47, wherein said image processing apparatus is a laser thermal printer.

60. An image processing apparatus according to claim 47, wherein a donor overlays said thermal print media and said printhead writes an image to said thermal print media by transferring a color from said dye donor sheet material to said thermal print media.

61. An image processing apparatus for receiving a medium for forming an image thereon, the image processor comprising:

a hollow vacuum imaging drum mounted for rotation about an axis and arranged to mount a thermal print media and dye donor material in superimposed relationship thereon, said thermal print media having a first length and width and said dye donor material having a second length and width greater than those of said thermal print media;

a vacuum pump connected to an interior of said vacuum imaging drum;

a first set of thermal print media sheet material vacuum holes and a second set of dye donor sheet material vacuum holes, said vacuum holes extending from the interior of said vacuum drum to a surface of said vacuum imaging drum to maintain the dye donor material and thermal print media on said vacuum imaging drum during rotation of said vacuum imaging drum;

an axially extending flat disposed in the surface of said vacuum imaging drum which is arranged to accept a leading and a trailing edge of the dye donor material;

a circumferential recess on the surface of said vacuum imaging drum arranged such that leading and trailing edges of the donor material overlie opposite edges of the axially extending flat without overlapping each other;

donor support rings forming the thermal print media circumferential recess on the surface of said vacuum imaging drum;

media contours arranged at the ends of the axial planner area formed in said donor support rings to support a dye donor material flute formed by the interface of the axially extending flat, dye donor support rings, thermal print media and the dye donor material.

* * * * *